US010201892B2

(12) United States Patent
Bruggmueller et al.

(10) Patent No.: US 10,201,892 B2
(45) Date of Patent: Feb. 12, 2019

(54) DRIVING-IN APPARATUS HAVING A HEATED PNEUMATIC ACCUMULATOR

(71) Applicant: Hilti Aktiengesellschaft, Schaan (LI)

(72) Inventors: Peter Bruggmueller, Bludesch (AT); Nikolaus Hannoschoeck, Grabs (CH); Christoph Boehm, Gams (CH)

(73) Assignee: Hilti Aktiengesellschaft, Schaan (LI)

( * ) Notice: Subject to any disclaimer, the term of this patent is extended or adjusted under 35 U.S.C. 154(b) by 345 days.

(21) Appl. No.: 14/917,676

(22) PCT Filed: Sep. 3, 2014

(86) PCT No.: PCT/EP2014/068703

§ 371 (c)(1),
(2) Date: Mar. 9, 2016

(87) PCT Pub. No.: WO2015/039866

PCT Pub. Date: Mar. 26, 2015

(65) Prior Publication Data

US 2016/0214249 A1 Jul. 28, 2016

(30) Foreign Application Priority Data

Sep. 19, 2013 (EP) ..... 13185169

(51) Int. Cl.
*B25C 1/08* (2006.01)
*B25C 1/04* (2006.01)

(52) U.S. Cl.
CPC ..... *B25C 1/08* (2013.01); *B25C 1/04* (2013.01); *B25C 1/047* (2013.01)

(58) Field of Classification Search
CPC .. B25C 1/00; B25C 1/04; B25C 1/041; B25C 1/042; B25C 1/008; B25C 1/08
(Continued)

(56) References Cited

U.S. PATENT DOCUMENTS 4,211,352 A 7/1980 Zilka
4,712,379 A * 12/1987 Adams ..... F02B 71/00 60/632

(Continued)

FOREIGN PATENT DOCUMENTS

DE 37 33 240 A1 4/1988
DE 92 01 613 U1 4/1992

(Continued)

OTHER PUBLICATIONS

European Search Report in European Application No. 13185169.3, dated Feb. 11, 2014.

(Continued)

*Primary Examiner* — Scott A. Smith

(74) *Attorney, Agent, or Firm* — Leydig Voit & Mayer

(57) ABSTRACT

A driving-in apparatus comprises a hand-held housing having an energy transmission element accommodated therein for transmitting energy to a fastening element to be driven in, and a drive device for driving the energy transmission element, wherein the drive device comprises an energy accumulator having a gas chamber which is fillable with a driving gas at a defined overpressure, wherein the overpressure is present in the gas chamber as stored driving energy prior to initiation of a driving-in operation, and wherein a piston of the energy transmission element forms a variable wall section of the gas chamber. The apparatus also includes a heating member providing thermal energy that is transferable into the driving gas enclosed in the gas chamber.

15 Claims, 1 Drawing Sheet

(58) Field of Classification Search
USPC .... 227/9, 10, 2, 130, 129; 123/46 R, 46 SC; 173/169, 208, 201, 212
See application file for complete search history.

(56) References Cited

U.S. PATENT DOCUMENTS

| | | | | |
|---|---|---|---|---|
| 4,773,581 | A * | 9/1988 | Ohtsu | B25C 1/08 123/46 SC |
| 4,913,331 | A | 4/1990 | Utsumi et al. | |
| 5,213,247 | A * | 5/1993 | Gschwend | B25C 1/08 227/10 |
| 6,123,241 | A * | 9/2000 | Walter | B25C 1/08 123/46 SC |
| 6,425,354 | B1 * | 7/2002 | Buchel | B25C 1/08 123/46 R |
| 6,666,366 | B2 * | 12/2003 | Rosenbaum | B25C 1/08 227/10 |
| 6,722,548 | B2 * | 4/2004 | Odoni | B25C 1/08 227/10 |
| 6,863,045 | B2 * | 3/2005 | Ricordi | B25C 1/08 123/262 |
| 6,971,568 | B2 * | 12/2005 | Schiestl | B25C 1/08 227/10 |
| 7,004,366 | B2 * | 2/2006 | Schiestl | B25C 1/08 123/46 SC |
| 7,178,487 | B2 * | 2/2007 | Zahner | B25C 1/08 123/46 H |
| 7,246,576 | B2 * | 7/2007 | Schiestl | B25C 1/08 123/46 H |
| 7,275,673 | B2 * | 10/2007 | Zahner | B25C 1/08 227/10 |
| 7,284,511 | B2 * | 10/2007 | Zahner | B25C 1/08 123/46 H |
| 7,798,383 | B2 * | 9/2010 | Liesse | B25C 1/08 123/46 SC |
| 7,980,440 | B2 * | 7/2011 | Hahn | B25C 1/08 123/46 SC |
| 8,205,582 | B2 * | 6/2012 | Adams | B25C 1/08 123/46 R |
| 8,267,298 | B2 * | 9/2012 | Zahner | B25C 1/08 227/10 |
| 8,499,991 | B2 * | 8/2013 | Spasov | B25C 1/003 227/131 |
| 8,561,869 | B2 * | 10/2013 | Towfighi | B25C 1/06 227/10 |
| 2005/0011507 | A1 | 1/2005 | Webb | |
| 2006/0102108 | A1 | 5/2006 | Panasik | |
| 2007/0131731 | A1 * | 6/2007 | Moeller | B25C 1/08 227/10 |
| 2009/0200353 | A1 | 8/2009 | Dittrich et al. | |
| 2012/0286014 | A1 | 11/2012 | Pedicini et al. | |

FOREIGN PATENT DOCUMENTS

| | | |
|---|---|---|
| DE | 10 2005 000107 A1 | 3/2007 |
| EP | 2 090 404 A2 | 8/2009 |
| WO | WO 03/037570 A1 | 5/2003 |

OTHER PUBLICATIONS

International Search Report in International Application No. PCT/EP2014/068703, dated Nov. 21, 2014.

* cited by examiner

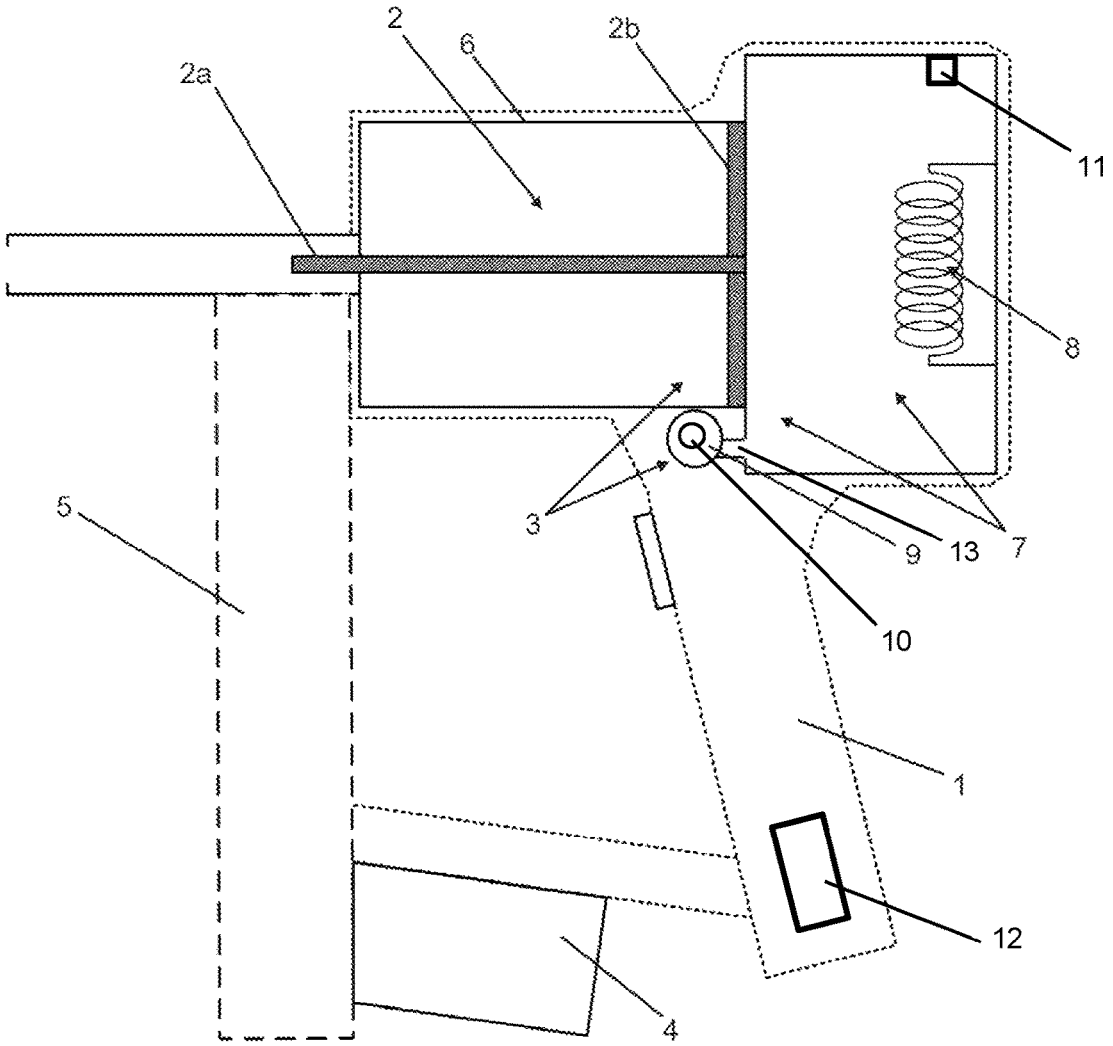
2
6
2b
2a
11
8
5
3
9
13
7
10
1
12
4

DRIVING-IN APPARATUS HAVING A HEATED PNEUMATIC ACCUMULATOR

CROSS-REFERENCE TO RELATED APPLICATIONS

The application is the U.S. National Stage of International Application Number PCT/EP2014/068703, filed on Sep. 3, 2014, which claims the benefit of European Patent Application Number 13185169.3, filed on Sep. 19, 2013, which are each incorporated by reference.

The invention concerns a fastener driving tool

BACKGROUND OF THE INVENTION

Fastener driving tools with various drive means are known from the prior art, including tools operated with external compressed air, tools operated with a combustible gas, or tools that have a mechanical spring mechanism.

DE 10 2005 000 107 A1, in the embodiment example shown in FIG. 1, describes a handheld fastener driving tool, in which a piston of a driving ram is accelerated with a force by compressed air of an accumulator chamber. After release of the driving ram, it is accelerated through expansion of the compressed air. The accumulator chamber is recharged by means of an electrically driven compressor.

It is the problem of the invention to specify a fastener driving tool that has good acceleration of an energy transmission element for a given tool size.

BRIEF SUMMARY OF THE INVENTION

This problem is solved for a fastener driving device of the kind mentioned above in accordance with the claimed invention. A reduction of pressure of the propellant gas due to cooling can be counteracted through the provision of a heating element. Through this, a uniform driving energy can be guaranteed independent of a wait time between the charging of the gas compartment and the beginning of the fastener driving operation.

A heating element in the sense of the invention is understood to be any structural element by means of which an amount of heat can be introduced into the propellant gas in a definite, preferably controllable way. The heat energy can be converted from originally chemically or physically stored energy, where basically all storage forms are possibilities. For example, besides electrical heating elements, combustion processes, catalytic exothermic reactions, or the like are also possible as heat sources.

A fastening element in the sense of the invention is understood to be any drivable nail, bolt, staple, pin, or even a screw.

The propellant gas is air in preferred embodiments, especially ambient air. However, it can also be gases such as air, nitrogen, or carbon dioxide from a pressurized reservoir or even reaction gases from a combustion process. What is important in the sense of the invention is that the propellant gas is stored in the gas compartment under pressure until the fastener driving operation is triggered. Regularly therefore, after charging the gas compartment, there is initially a temperature of the propellant gas present that lies above an ambient temperature and therefore is subject to dissipative energy loss.

In generally advantageous embodiments, the propellant gas is transported into the gas compartment by means of a compressor, preferably one that is integrated in the housing. This enables independence from external gas sources such as a compressed air line. Preferably, the compressor comprises an electric motor, where especially preferably the electric motor is at least optionally driven by a battery as its energy source. Through this, a cordless tool becomes possible, and at the same time the high energy densities of modern batteries can be utilized. In a preferred variation, the compressor comprises the piston, so that the propellant gas becomes compressed by a motion of the piston toward the gas compartment.

In an advantageous embodiment, a motor of the compressor is connected to the gas compartment in a thermally conductive manner, so that waste heat from the drive is utilized in order to reduce the cooling and the related decrease of pressure in the gas compartment. Through this, it is possible to save heating energy for the heating element. Preferably, the thermally conductive connection is brought about through a flow channel, through which a medium, for example cool air, flows from the motor to the gas compartment. According to other advantageous variations, the motor is arranged in or on the gas compartment.

In an advantageous embodiment, the driving device is an ignition element, which is provided to ignite the propellant gas and is preferably disposed in the gas compartment. The gas compartment is then a combustion chamber. Preferably, the gas compartment is connected in a thermally conductive way to a waste gas channel for waste gas that forms during the combustion of the propellant gas, so that the waste gas heat is utilized to reduce the cooling and the related decrease of pressure in the gas compartment. Through this, it is possible to save heating energy for the heating element. Especially preferably, it is possible for the waste gas to flow over one wall of the gas compartment, preferably as a part of the waste gas channel.

In a preferred embodiment of the invention, the heating element is made as an electrical heating element. This can be, for instance, a simple heating wire that is disposed within the gas compartment and is in contact with the propellant gas. Especially preferably, the heating element can be made as a PTC heating element. Such heating elements, which have a positive temperature coefficient (PTC), have good self-regulating properties and avoid overheating in a simple way.

In one possible further development of the invention, the heating element can comprise a thermal accumulator in order to allow flow of heat into the propellant gas even when the energy supply is disconnected.

For further optimization of the gas temperature and to reduce the energy consumption, the heating element can be controllable by means of a control circuit, in dependence on a measured temperature or another operating parameter. The operating parameter can, for example, be the elapsed time since a charging operation of the gas compartment.

Other features and advantages of the invention follow from the embodiment examples and the dependent claims. A number of preferred embodiment examples of the invention are described below and explained in more detail by means of the attached drawings.

BRIEF DESCRIPTION OF THE SEVERAL VIEWS OF THE DRAWING(S)

FIG. 1 shows a schematic sectional view of a fastener driving tool in accordance with the invention.

DETAILED DESCRIPTION OF THE INVENTION

The fastener driving tool from FIG. 1 in accordance with the invention comprises a handheld housing 1, in which an energy transmission element 2 with a driving device 3 is accommodated. The drive tool in this case comprises a gas compartment 7 and an ignition element 11, which can be filled with a propellant gas under a specific pressure by means of a compressor 9. In an embodiment example that is not shown, the gas compartment is supplied with pressure by the energy transmission element being moved toward the gas compartment with the gas compartment sealed, so that the compressor comprises the energy transmission element.

The energy transmission element 2 comprises a driving element 2*a* in the form of an essentially cylindrical ram. Fasteners are accommodated in a magazine 5. Through a feed mechanism (not shown), a fastener is transported each time into a chamber, from which it is accelerated by the action of the driving element 2*a* and driven into a workpiece (not shown) through a mouth piece. The driving element 2*a* is connected to a piston 2*b* of the energy transmission element 2, and the piston 2*b* is guided in a cylinder 6.

The gas compartment 7 can be filled with a propellant gas, in this case compressed air, at an excess pressure compared to the ambient pressure. The gas compartment 7 is enclosed by a solid wall segment, which also comprises a pressure-side part of the cylinder 6, and the movable piston 2*b* as a variable wall segment.

A heating element 8, by means of which heat energy can be transmitted to the propellant gas, is disposed in the gas compartment 7. In this case the heating element 8 is schematically designed as a simple electrical heating coil made of heating wire. The heating wire is situated in a central region of the gas compartment in order to enable as release of heat to the propellant gas that is as rapid and uniform as possible.

Filling the gas compartment 7 with the propellant gas or compressed air takes place by means of the compressor 9, which in the FIGURE is only schematically represented. The compressor 9 is driven by an electric motor 10, for example a spinning electric motor in combination with an oscillating mechanism. The energy source for the electric drive is a battery 4 provided on the housing 1.

For examples of design detail of the compressor and its drive and other components of the fastener driving tool such as a triggering device and a return spring for the energy transmission element, one is referred in particular to DE 10 2005 000 107 A1.

The invention now operates as follows:

With the piston 2*b* in the indicated initial position, ambient air is pumped into the gas compartment 7 via a flow channel 13 by means of the compressor, until a specific pressure is reached. This can in particular be a maximum pressure of the compressor. In the course of compression of the propellant gas, it becomes heated, so that in the fully charged state of the gas compartment a gas temperature is present that lies above the ambient temperature.

In this state, the tool can be triggered when required, which takes place by an electromechanical release of the previously locked energy transmission element 2. After its release, the piston 2*b* is accelerated forward by the applied pressure.

Over a period of time between the charging of the gas compartment and the triggering of the fastener driving operation, which is dependent on the operator, there is an increase in cooling of the propellant gas due to release of heat to the environment. Because of this, the pressure of the propellant gas, and thus the available fastener driving energy, decreases.

To counteract this loss, the heating element 8 is activated. Here the heating element is heated via the electric energy of the battery 4.

There are various possibilities for control of the heating element, of which some are mentioned below as examples:

- Control of the heating element 8 in dependence on a measured gas temperature, for which a temperature sensor in or on the gas compartment 7 is necessary (not shown).
- Control of the heating element 8 in dependence on a measured gas pressure, for which a pressure sensor in the gas compartment 7 is necessary (not shown).
- Control of the heating element 8 in dependence on a time elapsed since the compressor 9 turned off
- Sustained activation of the heating element 8 after switching off the compressor 9. A maximum activation time can be provided in order to spare the battery 4.
- Manual activation of the heating element before a fastener driving operation. In this case a certain wait time can be provided.

The control of the heating element 4 can take place in particular via a central control circuit 12 of the fastener driving apparatus.

After driving in the fastener, the energy transmission element 2 is reset to the initial position by a return spring (not shown) and locked in place. This is followed by refilling of the gas compartment 7 by the compressor 9.

The invention claimed is:

1. A fastener driving tool for driving a fastening element, the fastener driving tool comprising a handheld housing having accommodated therein, an energy transmission element for transmitting energy to the fastening element, the energy transmission element comprising a piston;

a heating element; and a driving device for driving the energy transmission element the driving device comprising an energy accumulator with a gas compartment, the gas compartment having variable wall segments and a gas compartment volume, which can be filled with a propellant gas at a specific excess pressure, such that the excess pressure in the gas compartment is present as stored driving energy before triggering operation of the fastening driving tool to drive the fastening element, and wherein the piston of the energy transmission element forms a variable wall segment of the gas compartment, and heat energy can be transmitted into the propellant gas enclosed in the gas compartment via the heating element.

2. The fastener driving tool as in claim 1, wherein the propellant gas is transported into the gas compartment by a compressor.

3. The fastener driving tool as in claim 2, wherein the compressor comprises an electric motor.

4. The fastener driving tool as in claim 3, wherein the electric motor is driven by a battery as an energy source.

5. The fastener driving tool as in claim 3, wherein the motor is thermally conductively connected to the gas compartment.

6. The fastener driving tool as according to claim 5, wherein the drive motor of the compressor is connected to the gas compartment via a flow channel.

7. The fastener driving tool as according to claim 6, wherein the flow channel is disposed in or on the gas compartment.

8. The fastener driving tool as according to claim 3, wherein a drive motor of the compressor is thermally conductively connected to the gas compartment.

9. The fastener driving tool as according to claim 2, wherein the compressor is integrated into the housing.

10. The fastener driving tool as in claim 1, wherein the driving device comprises an ignition element for ignition of the propellant gas.

11. The fastener driving tool as according to claim 10, wherein the ignition element is disposed in the gas compartment.

12. The fastener driving tool as in claim 1, wherein the heating element is an electrical heating element.

13. The fastener driving tool as in claim 12, wherein the heating element is a PTC heating element.

14. The fastener driving tool as in claim 1, wherein the heating element can be controlled by a control circuit, in dependence on a measured temperature, or a measured pressure.

15. The fastener driving tool according to claim 1, wherein the heat energy can be transmitted into the propellant gas after filling the gas compartment to the specific excess pressure.

* * * * *